United States Patent [19]

Hisada et al.

[11] 4,201,933

[45] May 6, 1980

[54] ELECTRON GUN STRUCTURE FOR A PICKUP TUBE

[75] Inventors: Takanori Hisada, Yokohama; Kyohei Fukuda, Mobara, both of Japan

[73] Assignee: Hitachi, Ltd., Japan

[21] Appl. No.: 908,372

[22] Filed: May 22, 1978

[30] Foreign Application Priority Data

May 27, 1977 [JP] Japan ..... 52-60974

[51] Int. Cl.[2] ..... H01J 29/56

[52] U.S. Cl. ..... 315/16

[58] Field of Search ..... 315/16

[56] References Cited

U.S. PATENT DOCUMENTS

| | | | |
|---|---|---|---|
| Re. 25,127 | 2/1962 | Szegho | 315/16 |
| 2,227,033 | 12/1940 | Schlesinger | 315/16 |
| 2,971,118 | 2/1961 | Burdick | 315/16 |
| 3,090,882 | 5/1963 | Benway | 315/16 X |

FOREIGN PATENT DOCUMENTS

| | | | |
|---|---|---|---|
| 646585 | 10/1962 | Italy | 315/15 |

*Primary Examiner*—Malcolm F. Hubler

*Attorney, Agent, or Firm*—Craig and Antonelli

[57] ABSTRACT

An electron gun structure for a pickup tube comprises a cathode lens electrode assembly, a beam disc electrode and a main lens electrode assembly. The main lens electrode assembly includes first and second electrodes adapted to be supplied with different potentials so as to form a bipotential electron lens in the main lens electrode assembly. The beam disc electrode which has a beam limiting hole is adapted to be supplied with a potential not higher than about 2.5 times the lower one of the potentials to be supplied to the first and second electrodes in the main lens electrode assembly.

5 Claims, 4 Drawing Figures

ELECTRON GUN STRUCTURE FOR A PICKUP TUBE

LIST OF PRIOR ART REFERENCES

The following reference is cited to show the state of the art:

Journal of the SMPTE Vol. 71 Oct. 1962 pp. 772–775.

This invention relates to a pickup tube of the electrostatic focusing type or of a combined electrostatic and magnetic focusing type, and more particularly to an electron gun structure for such a pickup tube.

Pickup tubes of the electrostatic focusing type have found limited applications hitherto due to the extremely low resolution compared with pickup tubes of electromagnetic focusing type although they are advantageous over the latter in that they do not require the focusing coil assembly and are small in size and light in weight. The beam diameter on the target of the pickup tube is the principal factor which determines the resolution of the pickup tube. This beam diameter is not substantially affected by the space charge but by the magnification, spherical aberration and chromatic aberration of the main lens in the electron gun structure of the pickup tube. The prior art pickup tube of electrostatic focusing type employs a unipotential electron lens as a main lens and therefore has been defective in that its spherical aberration and chromatic aberration are considerably larger than those of the main lens in a pickup tube of electromagnetic focusing type.

It is therefore a primary object of this invention to provide an electron gun structure for a pickup tube of electrostatic focusing type or of combined electrostatic and magnetic focusing type and is effective to improve the resolution of such a pickup tube.

In the electron gun structure according to this invention, a bipotential electron lens is employed as a main lens to thereby decrease the spherical aberration, and the potential on the beam disc electrode having a beam limiting hole is selected to be not higher than about 2.5 times the potential on that electrode of those serving to form the bipotential electron lens which is at the lower potential to thereby suppress undesirable divergence of the electron beam due to the electric field formed between the beam disc electrode and the lower potential electrode for the bipotential electron lens, minimize the spherical aberration of the main lens and reduce the magnification and the chromatic aberration of the main lens.

Features and advantages of this invention will become more apparent from the following detailed description of a preferred embodiment thereof taken in conjunction with the accompanying drawings, in which.

Figure 1:
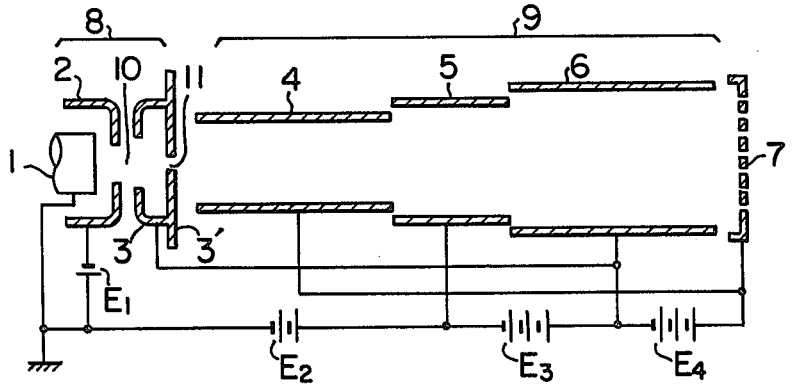
FIG. 1 PRIOR ART
FIG. 1 is a sectional diagram of a conventional electron gun structure and some parts associated therewith of an electrostatic focusing type.

Reference will first be made to FIG. 1 showing a conventional electron gun structure for a pickup tube of the electrostatic focusing type, in which the electron gun structure comprises a first electrode assembly 8 for forming a cathode lens and a second electrode assembly 9 for forming a main lens. The cathode lens electrode assembly 8 including a cathode 1 and electrodes 2 and 3 causes an electron beam emitted from the cathode 1 to establish a crossover at the central portion 10 on the tube axis intermediate between the electrodes 2 and 3. The electron beam passes through a beam limiting hole 11 provided at a beam disc electrode 3' which is kept at the same potential as the electrode 3, is focused by the main lens electrode assembly 9 including electrodes 4, 5 and 6 and then passes through a mesh electrode 7 to provide a beam spot of a minimum diameter on a target (not shown) of the tube.

The potential source serves to supply the electrodes 4, 5 and 6 with potentials $E_2$–$E_4$ such that the intermediate electrode 5 is at a potential lower than those of the other electrodes 4 and 6 to form a unipotential electron lens. As a result, a pickup tube using such an electron gun structure is defective in that the spherical aberration and the chromatic aberration are larger than those of a pickup tube of the electromagnetic focusing type and therefore the resolution is decreased. Potential $E_1$ is for supplying the electrode 2 with a negative potential with respect to the cathode 1 to control the electron beam.

Figure 2:
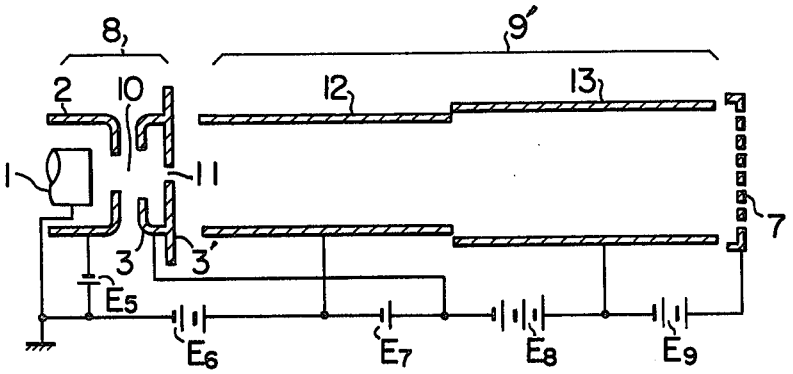
FIG. 2 is a sectional diagram similar to FIG. 1, showing one embodiment of this invention.

A preferred embodiment of the invention will now be described with reference to FIG. 2, in which like parts are denoted by identical numerals as those used in FIG. 1. The electron gun structure comprises a cathode lens electrode assembly 8, a beam disc electrode 3', a main lens electrode assembly 9' and a potential source for supplying the cathode lens electrode assembly 8, the beam disc electrode 3' and the main lens electrode assembly 9' with various potentials. The cathode lens electrode assembly 8 includes a cathode 1, an electrode 2 and another electrode 3, as in FIG. 1. The main lens electrode assembly 9' includes a first electrode 12 and a second electrode 13 arranged in succession in the direction of the passage of an electron beam from the cathode 1. The beam disc electrode 3' has a beam limiting hole 11 and is adapted to be supplied with the same potential as that of the electrode 3. Therefore, the electrodes 3 and 3' may be in an integral structure as shown. Numeral 7 denotes a mesh electrode and serves to form a collimator lens along with the second electrode 13. The electrode 2 is supplied with a negative potential $-E_5$ by a potential source for controlling an electron beam emitted from the cathode 1. The potential source includes means for supplying the electrode 3 and the beam disc electrode 3' with a potential $E_6+E_7$, the first electrode 12 with a potential $E_6$ and the second electrode 13 with a potential $E_6+E_7+E_8$ to form a bipotential electron lens in the main lens electrode assembly 9'. The mesh electrode 7 is supplied with a potential $E_6+E_7+E_8+E_9$ by the potential source. The potentials on the electrodes 3 (3'), 12, 13 and 7 may be 100 V, 75 V, 750 V and 1000 V, respectively.

In a pickup tube the maximum beam diameter is about one-fifth of the lens diameter, and the spherical aberration C of the third order is predominant. (That is, $C=C_s \cdot \theta^3$, where $C_s$ represents the coefficient of aberration and $\theta$ represents the angle of divergence of the electron beam.) And, the aberration coefficient $C_s$ is generally expressed as $$C_s = \frac{1}{64\sqrt{\phi_0}} \int_{Z_0}^{Z_1} \sqrt{\phi}\,(4G'^2 + 3G^4 - 5G^2G' - GG'')u_\alpha^4\,dZ \quad (1)$$

where $G = \phi/\phi'$

Z: distance to a point on the tube axis measured from an origin on the axis $\phi$: voltage on Z measured from the potential on the cathode prime (′): differentiation with respect to Z $Z_0$: object point $Z_1$: image point $\phi_0$: $\phi$ at $Z_0$ $u_\alpha(Z)$: value of a distance between a point on the electron trajectory and the tube axis with respect to Z, which value satisfies the initial conditions $u_\alpha(Z_0)=0$ and $u'_\alpha(Z_0)=1$.

It will be seen from the equation (1) that the value of $C_s$ is influenced most greatly by $u_\alpha$, and the value of $C_s$ can be reduced to a minimum by minimizing the maximum value of $u_\alpha$.

Figure 3:
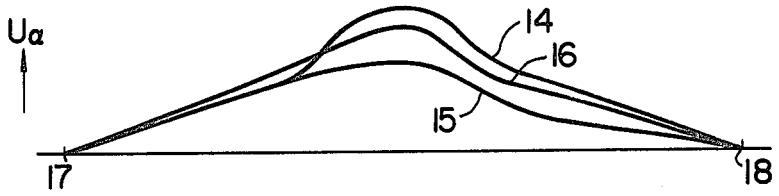
FIG. 3 is a diagram illustrating electron trajectory in pickup tubes with an electron gun structure according to this invention and with that according to prior art.

Electron trajectory $u_\alpha$ was calculated by the computer simulation and illustrated in FIG. 3. The curve 14 represents the value of $u_\alpha$ in the prior art electron gun structure employing the unipotential electron lens while the curve 15 represents the value of $u_\alpha$ in the embodiment of the present invention which employs the bipotential electron lens. In FIG. 3, the reference numerals 17 and 18 designate the object point and image point respectively. It can be seen from FIG. 3 that the bipotential electron lens is advantageous over the unipotential electron lens for minimizing the value of $C_s$. Actual measurement of the spherical aberration of the main electron lenses in the prior art electron gun structure and in the electron gun structure embodying the present invention has proved that the value of $C_s$ is about 2.4 μm in the latter under the potential conditions mentioned above with reference to FIG. 2, whereas it is about 10.0 μm in the former, when the angle of divergence of the beam is 1°. Thus, the value of $C_s$ in the embodiment of the present invention is about ¼ that in the prior art electron gun structure.

When the potential on the beam disc electrode 3′ is set to be extremely higher than that on the first electrode 12 in the bipotential electron lens (i.e., on that electrode to which a lower potential is supplied to form the bipotential lens), the lens formed by the electrodes 3 and 12 acts to provide an increased beam diverging effect which increases $u_\alpha$, hence the value of $C_s$. This fact is illustrated by the curve 16 in FIG. 3. The curve 16 represents the value of $u_\alpha$ when the potential on the electrode 3′ only is set at 300 volts while maintaining those on the other electrodes 12, 13 and 7 unchanged.

Figure 4:
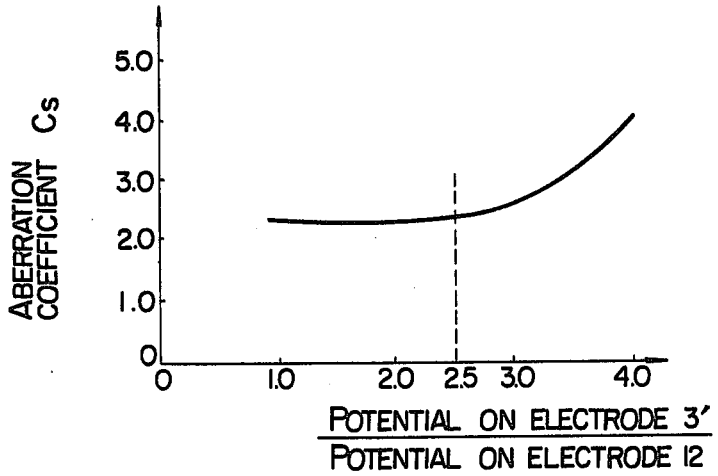
FIG. 4 is a graph showing a relation between the spherical aberration of an electron lens and the potentials supplied to electrodes serving to form the lens.

FIG. 4 shows the value of $C_s$ relative to the ratio between the potential on the electrode 3′ with the beam limiting hole 11 and that on the lower potential electrode 12 in the embodiment of the present invention. It can be seen from FIG. 4 that the ratio of the potential on the electrode 3 to that on the electrode 12 must not be higher than about 2.5 in order to make negligible the beam diverging effect of the lens formed by these electrodes 3 and 12.

The magnification of the electron lens is adversely affected when the potential on the electrode 3′ is selected to be too high. The magnification M of an electron lens is generally given by the following equation:

$$M = b/a\sqrt{V_a}/V_b \ldots \quad (2)$$

where a and b represent the distances from the principal plane of the lens to the object point and image point respectively, and $V_a$ and $V_b$ represent potentials on the object point and image point respectively. In the prior art electron gun structure employing the unipotential electron lens, there have been the relations $a \approx b$ and $V_a \approx V_b$, and the magnification M has been approximately equal to unity. In contrast to the prior art electron gun structure, the relations $V_a << V_b$ and $a \approx b$ hold, and the lens acts as a minifying system in the electron gun structure embodying the present invention, since the electrode 3′ has a reduced potential as described previously.

Actual measurement of the magnification M of the electron lens in the prior art electron gun structure and the electron gun structure embodying the present invention has proved that M=0.69 in the case of the present invention, whereas M=0.91 in the case of the prior art. Thus, the beam diameter on the target can be greatly reduced according to the present invention. Further, the chromatic aberration of the electron lens in the electron gun structure embodying the present invention is only about 0.7 times that in the prior art one.

It will be apparent from the above discussion on the three factors of the electron lens that the beam diameter on the target in the pickup tube with the electron gun structure embodying the present invention is about 60% of that in the prior art pickup tube, and thus, the resolution can be greatly improved. It will thus be seen that employment of a main electron lens of bipotential focusing type is advantageous over that of unipotential focusing type in a tube such as a pickup tube in which the effect of the space charge is not so appreciable due to the small beam current, and the resolution is greatly affected by the three factors, that is, the spherical aberration, magnification and chromatic aberration of the main electron lens system. Although the electron beam tends to be diverged by the beam disc electrode 3 and the first or lower potential electrode 12 of the main electron lens since the potential on the electrode 3′ is usually higher than that at the electrode 12 when the main electron lens is of the bipotential focusing type, this beam diverging effect can be minimized and the magnification can also be reduced to a minimum by selecting the potential on the electrode 3′ to be not higher than about 2.5 times that on the electrode 12, so as to fully utilize the merits of the bipotential focusing electron lens.

It will be understood from the foregoing detailed description that the present invention provides an electron gun structure for a pickup tube of electrostatic focusing type or of combined electrostatic and magnetic focusing type in which the spherical aberration, magnification and chromatic aberration of the main electron lens of the bipotential focusing type are respectively about ¼, 0.76 times and 0.7 times those of the main electron lens of the unipotential focusing type employed in the prior art, thereby greatly obviating the sources which deteriorate the resolution of the main electron lens.

We claim:

1. An electron gun structure for a pickup tube having a target, comprising: a cathode lens electrode assembly including a cathode for producing an electron beam and a plurality of electrodes; an beam disc electrode having a beam limiting hole; a main lens electrode assembly for accelerating and focusing said electron beam, said beam disc electrode being between said cathode lens electrode assembly and said main lens electrode assembly; and means for supplying potentials to said cathode lens electrode assembly, said beam disc electrode and said main lens electrode assembly for establishing a crossover in said cathode lens electrode assembly and for making the beam spot on the target of the tube minimum; in which said main lens electrode assembly includes a first electrode and a second electrode arranged in succession in the direction of the passage of said electron beam, and said potential supplying means includes first means for supplying said first and second electrodes with first and second potentials to form a bipotential electron lens in said main lens electrode assembly and second means for supplying said beam disc electrode with a third potential, said first potential being lower than said second potential and said third potential being not higher than about 2.5 times said first potential to control the coefficient of aberration of the main lens electrode assembly.

2. An electron gun structure according to claim 1, in which said cathode lens electrode assembly includes two electrodes, one being supplied with a negative potential and the other being supplied with a positive potential by said potential supplying means, and said other electrode in said cathode lens electrode assembly is kept at the same potential as that of said beam disc electrode.

3. An electron gun structure for a pickup tube having a target, comprising: a cathode lens electrode assembly including a cathode for producing an electron beam and a plurality of electrodes; a beam disc electrode having a beam limiting hole; a main lens electrode assembly for accelerating and focusing said electron beam, said beam disc electrode being between said cathode lens electrode assembly and said main lens electrode assembly; and means for supplying potentials to said cathode lens electrode assembly, said beam disc electrode and said main lens electrode assembly for establishing a crossover in said cathode lens electrode assembly and for making the beam spot on the target of the tube minimum; in which said main lens electrode assembly includes a first electrode and a second electrode arranged in succession in the direction of the passage of said electron beam, and said potential supplying means includes first means for supplying said first and second electrodes with first and second potentials to form a bipotential electron lens in said main lens electrode assembly and second means for supplying said beam disc electrode with a third potential, said first potential being lower than said second potential and the ratio of said third potential to said first potential being set to provide substantially a minimum coefficient of aberration for the main lens electrode assembly.

4. An electron gun structure according to claim 3, wherein the third potential is not greater than 2.5 times the first potential.

5. An electron gun structure according to claim 3 or 4, wherein the ratio of the third potential to the first potential is set to provide a coefficient of aberration of substantially 2.4 $\mu$m.

* * * * *